US009663960B2

(12) United States Patent
Sladojevic

(10) Patent No.: US 9,663,960 B2
(45) Date of Patent: May 30, 2017

(54) ANCHOR FOR LIFTING A CONCRETE COMPONENT

(75) Inventor: Robert Sladojevic, Cherry Gardens (AU)

(73) Assignee: PRE-FORM SYSTEMS DUO, Temerin (RS)

( * ) Notice: Subject to any disclaimer, the term of this patent is extended or adjusted under 35 U.S.C. 154(b) by 0 days.

(21) Appl. No.: 13/511,650

(22) PCT Filed: Nov. 25, 2009

(86) PCT No.: PCT/AU2009/001539

§ 371 (c)(1),
(2), (4) Date: May 23, 2012

(87) PCT Pub. No.: WO2010/063060

PCT Pub. Date: Jun. 10, 2010

(65) Prior Publication Data

US 2012/0279145 A1 Nov. 8, 2012

(30) Foreign Application Priority Data

Feb. 12, 2008 (AU) ..... 2008906244

(51) Int. Cl.

| | |
|---|---|
| ***E04G 21/14*** | (2006.01) |
| ***E02D 35/00*** | (2006.01) |
| ***E04G 21/18*** | (2006.01) |

(52) U.S. Cl.

CPC ..... *E04G 21/142* (2013.01); *E04G 21/185* (2013.01)

(58) Field of Classification Search

USPC ..... 52/125.4, 698, 712, 295, 122.1, 125.1, 52/125.2, 125.3; 405/259.5, 259.6

See application file for complete search history.

(56) References Cited

U.S. PATENT DOCUMENTS

| | | | | |
|---|---|---|---|---|
| 1,468,285 | A * | 9/1923 | Dampney | 52/259 |
| 1,699,206 | A * | 1/1929 | Prickett | 52/713 |
| 3,160,988 | A * | 12/1964 | Williams | 52/714 |
| 3,290,983 | A * | 12/1966 | Drinko et al. | 411/446 |
| 3,705,469 | A * | 12/1972 | Eriksson | 52/125.4 |
| 3,705,649 | A * | 12/1972 | Arvanitakis | 210/770 |
| 4,000,591 | A * | 1/1977 | Courtois | 52/689 |
| 4,304,431 | A * | 12/1981 | Walston | 294/89 |
| 4,512,121 | A * | 4/1985 | Carydias et al. | 52/125.2 |
| 5,054,146 | A * | 10/1991 | Wiesenfeld et al. | 470/16 |
| 5,094,047 | A | 3/1992 | Kelly et al. | |
| 6,279,274 | B1 * | 8/2001 | Amiet et al. | 52/125.2 |
| 8,281,531 | B2 * | 10/2012 | Dent | 52/296 |
| 2003/0140575 | A1 * | 7/2003 | Sanftleben et al. | 52/125.4 |
| 2004/0168375 | A1 * | 9/2004 | Sack | 52/125.4 |
| 2005/0055956 | A1 * | 3/2005 | Hardy | 52/698 |

(Continued)

FOREIGN PATENT DOCUMENTS

| | | |
|---|---|---|
| DE | 29713029 U1 | 9/1997 |
| WO | WO-02/44495 A1 | 6/2002 |

*Primary Examiner* — Joshua J Michener
*Assistant Examiner* — Kyle Walraed-Sullivan

(57) ABSTRACT

An anchor for use in lifting a concrete component, said anchor comprising a single length of wire bent to form a head engagable with a clutch of a lifting system, and a body portion for embedment with the concrete component, wherein the wire is bent such that opposed legs of the body portion extend in a plane substantially perpendicular to a plane of the head portion.

11 Claims, 10 Drawing Sheets

(56) References Cited

U.S. PATENT DOCUMENTS

| | | | | |
|---|---|---|---|---|
| 2005/0257445 | A1* | 11/2005 | Neef et al. | 52/125.2 |
| 2008/0028718 | A1* | 2/2008 | Erickson et al. | 52/687 |
| 2009/0107057 | A1* | 4/2009 | Hansort | 52/125.4 |
| 2010/0037536 | A1* | 2/2010 | Schulze | 52/125.4 |

* cited by examiner

ANCHOR FOR LIFTING A CONCRETE COMPONENT

This application is the National Stage under 35 USC §371 of International Application Number PCT/AU2009/001539, which was filed on Nov. 25, 2009.

FIELD OF THE INVENTION

This invention relates to an anchor for lifting a concrete component and, more particularly but not exclusively, to an edge lift anchor for lifting a concrete panel.

BACKGROUND OF THE INVENTION

It is known to lift a concrete panel by way of an anchor embedded within the concrete panel during casting of same. A typical anchor of this kind is formed from metal by cutting the anchor from a plate. However, the applicant has identified that such typical anchors are relatively expensive to produce due to the cutting procedure, and that use of such typical anchors may be restrictive as the anchor must be located at or near a central plane of the panel. Lifting anchors fabricated by cutting plate material require a lot of energy to produce, and often have irregularities. Disadvantages also result from the anchors being cut from plate, as the anchors are typically planar and for correct orientation for lifting require legs of the anchor to extend across a large portion of the thickness of the concrete panel. Moreover, the applicant has identified that a significant amount of waste material is produced as a by-product in the manufacture of existing lifting anchors.

Examples of the invention seek to solve, or at least ameliorate, one or more disadvantages of previous lifting anchors.

SUMMARY OF THE INVENTION

In accordance with one aspect of the present invention, there is provided an anchor for use in lifting a concrete component, said anchor comprising a single length of wire bent to form a head portion engagable with a clutch of a lifting system, and a body portion for embedment with the concrete component, wherein the anchor is formed such that opposed legs of the body portion extend in a plane inclined to a plane of the head portion.

Preferably, the plane of the legs is rotated about a central axis relative to the plane of the head portion. More preferably, an angle between the plane of the legs and the plane of the head portion is approximately 90 degrees. Alternatively, an angle between the plane of the legs and the plane of the head portion is oblique, preferably approximately 60, 45, 30 or 15 degrees.

Preferably, the head portion is twisted relative to the body portion about the central axis of the anchor. More preferably, the central axis is in the plane of the head portion.

In one form, the head portion is twisted through an angle of 90 degrees relative to the body portion about the central axis of the anchor. In an alternative form, the head portion is twisted through an angle of 270 degrees relative to the body portion about the central axis of the anchor.

Preferably, the head portion is bent out of the plane of the legs by an angle corresponding to an angle of an edge profile of the concrete component. In particular examples, the angle may be 9 degrees, 15 degrees, 22.5 degrees, 30 degrees of 45 degrees, however it will be understood by those skilled in the art that the angle may be anything from 0-90 degrees.

Preferably, the opposed legs extend outwardly from the central axis. More preferably, each of the opposed legs has ripple bends in the plane of the body portion.

Preferably, the anchor includes a collar adapted to fit around the head portion, wherein the collar forms abutment shoulders for cooperation with a body of the clutch to limit clutch rotation.

Preferably, the anchor includes a shear bar extending generally perpendicularly to the central axis, and generally in the plane of the body portion.

Preferably, the shear bar engages in a groove of the collar.

Alternatively, the shear bar is welded to the wire.

Preferably, the shear bar is formed in a generally wave-like shape, with lateral oscillations generally perpendicular to the central axis of the anchor.

Preferably, the anchor includes a second like shear bar, wherein a major axis of the second shear bar is generally parallel to a major axis of the first shear bar and is substantially a mirror image of the first shear bar when viewed from above a top end of the anchor.

In a preferred form, the length of wire is in the form of a length of metal bar, and the anchor is formed by bending the length of metal bar. More preferably, the head portion is formed by bending the metal bar around a forming piece, the forming piece having a size corresponding to a size of a clutch portion to pass through the head portion. Even more preferably, the length of metal bar is drawn from a coil.

In accordance with another aspect of the present invention, there is provided an anchor assembly including an anchor as described above, and a chair for supporting the anchor in the concrete component, with the plane of the body portion oriented substantially parallel to a central plane of the concrete component.

BRIEF DESCRIPTION OF THE DRAWINGS

The invention is described, by way of non-limiting example only, with reference to the accompanying drawings in which.

DETAILED DESCRIPTION

Figure 1:
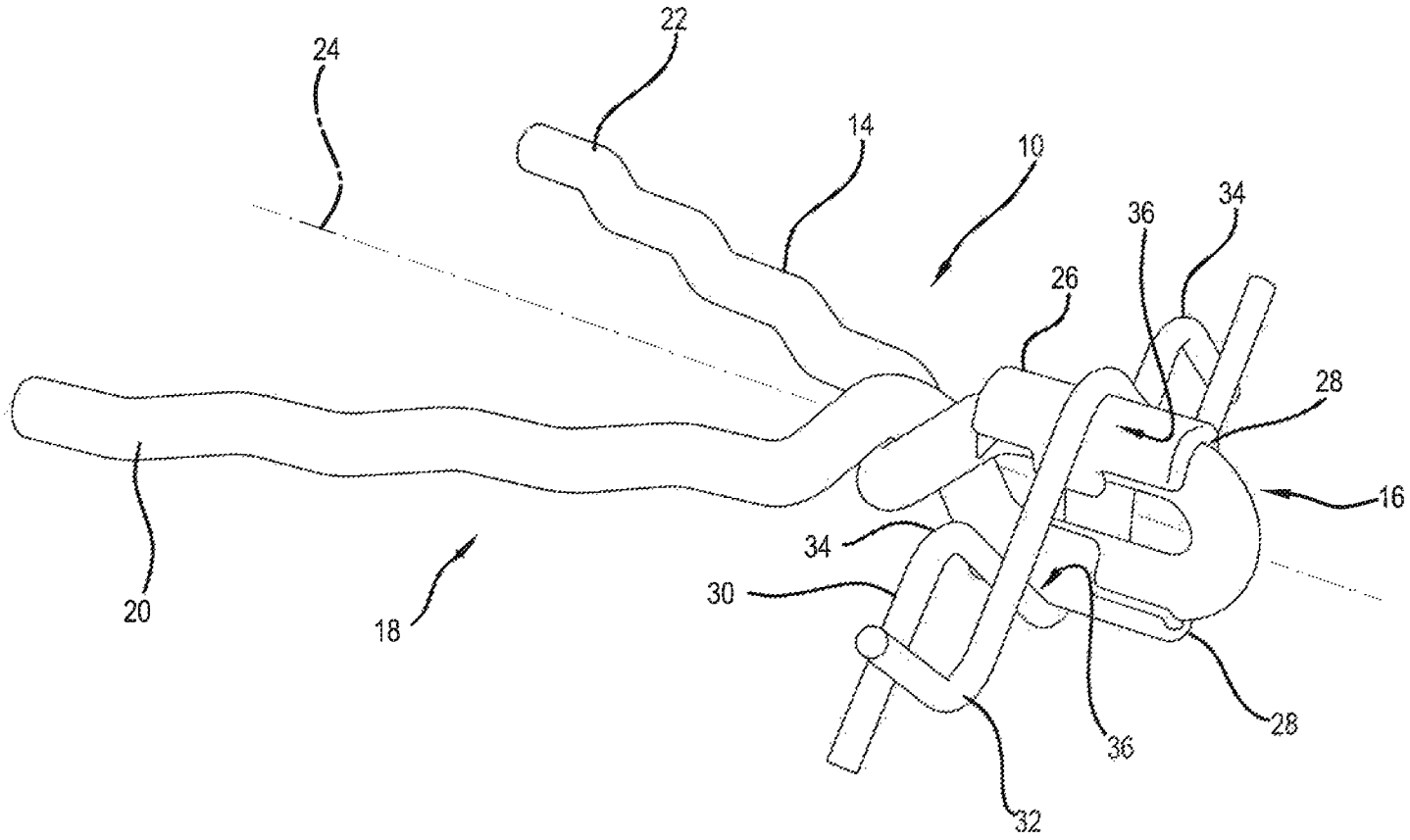
FIG. 1 is a perspective view of a lifting anchor in accordance with an example of the present invention.
Figure 7:
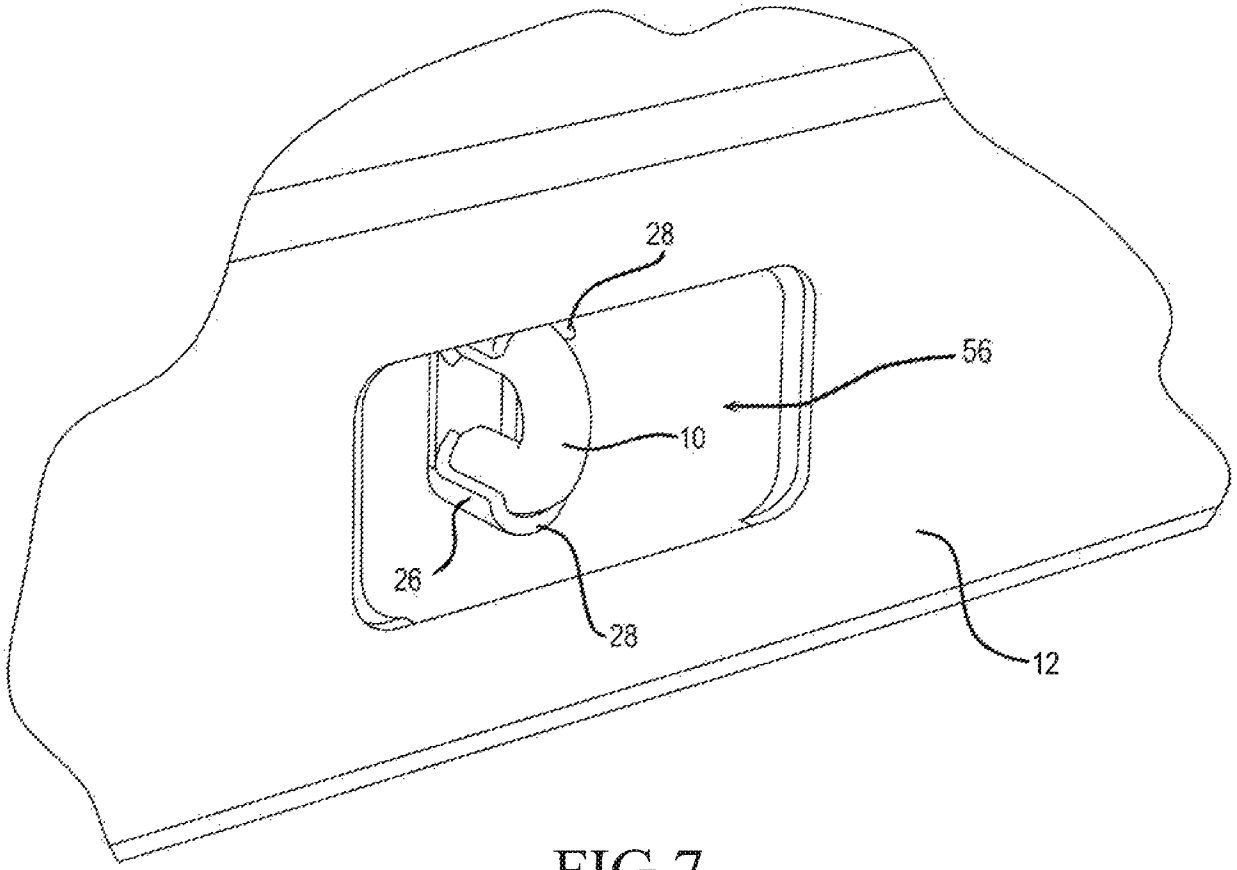
FIG. 7 is a perspective view of an edge of a concrete component with the anchor embedded therein.

With reference to FIG. 1, there is shown an anchor 10 for use in lifting a concrete component 12 (FIG. 7). The anchor 10 shown is in the form of an edge lift anchor, however it will be appreciated by those skilled in the art that alternative examples of the present invention may be in the form of other types of anchors such as, for example, a face lift anchor.

The anchor 10 comprises a single length of wire or rod 14 bent to form a head portion 16 engageable with a clutch of a lifting system, and a body portion 18 for embedment within the concrete component 12. The wire 14 is bent such that opposed legs 20, 22 of the body portion 18 extend in a plane substantially perpendicular to a plane of the head portion 16. By virtue of the wire 14 being bent in this way, the anchor 10 is able to be arranged such that the opposed legs 20, 22 lie in a plane substantially parallel to a central plane of the concrete component 12, while the head portion 16 is oriented substantially perpendicularly to the central plane of the concrete component 12. Advantageously, this enables the anchor 10 to be located lower in the concrete component 12 to facilitate edge lifting of the concrete component 12, while facilitating a broad spread of the opposed legs 20, 22 within the concrete component 12.

As the legs 20, 22 are spread outwardly from a central axis 24, the load applied to the anchor 10 is distributed through a larger region of the concrete component 12 than is possible with a typical concrete anchor having parallel legs. Accordingly, this reduces the likelihood of the concrete component 12 failing during lifting, as a large region of the concrete component 12 must fail for the anchor 10 to be torn out during lifting. Each of the legs 20, 22 may be formed with a wave-like configuration to provide increased surface area by incorporating a series of ripples to provide additional anchorage of the anchor 10 within the concrete component 12. Advantageously, the ripples inhibit withdrawal of the legs 20, 22 from the concrete, by applying compression to the concrete during lifting. As such, the opposed legs 20, 22 are able to provide the same function as ancillary tension bars which have been used in existing lifting anchors, thus eliminating the need for a separate tension bar.

To achieve the perpendicular configuration, the head portion 16 in the example shown is twisted through an angle of 270 degrees relative to the body portion 18 about the central axis 24 of the anchor 10. In alternative anchors, to achieve a perpendicular configuration the head portion may be twisted through an angle of 90 degrees (or, more generally, an angle of $90+180\times$, where x is a non-negative integer) relative to the body portion 18 about the central axis 24 of the anchor 10. The central axis 24 is in the plane of the head portion 16. In this way, the plane of the head portion 16 is perpendicular to the plane of the body portion 18.

It will be understood that in other examples of the invention, the body portion 18 may be rotated about the central axis 24 relative to the head portion 16 such that the plane of the body portion 18 is out of the plane of the head portion 16 by an angle other than 90 degrees. In particular alternatives, this angle may be approximately 60, 45, 30 or 15 degrees, as may be appropriate depending on the shape and/or orientation of the concrete component 12.

The anchor 10 includes a collar 26 adapted to fit around the head portion 16, as shown in FIG. 1. The collar 26 forms abutment shoulders 28 at upper and lower locations of the head portion 16 for cooperation with a body of the clutch to limit clutch rotation relative to the anchor 10.

A pair of shear bars 30, 32 extend generally perpendicularly to the central axis 24, generally perpendicularly to the plane of the body portion 18. These shear bars 30, 32 assist in preventing shear failure of the concrete component 12 during lifting, and provide improved anchorage of the anchor 10 within the concrete component 12. Each of the shear bars 30, 32 is formed in a generally wave-like shape, with lateral oscillations 34 in a direction generally perpendicular to the central axis 24 of the anchor 10. A second one of the shear bars 30 is located adjacent a first one of the shear bars 32, and is reversed such that the second shear bar 30 is substantially a mirror image of the first shear bar 32 when viewed from an end of the anchor 10 along the central axis 24. The shear bars 30, 32 may be positively held in place relative to the head portion 16 by engagement of the shear bars 30, 32 within grooves 36 formed in the collar 26. The grooves 36 formed on opposite sides of the collar 26 may be formed in a correspondingly offset configuration so as to positively locate the shear bars 30, 32 in the arrangement shown. Alternatively, the shear bars 30, 32 may be fixed relative to the head portion 16 by welding of the shear bars 30, 32 to the wire 14 of the head portion 16.

The collar 26 may be formed of plastic, metal or a different material. The length of wire 14 from which the anchor 10 is formed may be a length of metal bar which is bent to form the anchor 10. The length of metal bar may be drawn from a coil. Advantageously, by virtue of the anchor 10 being formed from metal bar, material wastage is minimised, and the anchor 10 is manufactured in a particularly cost-effective manner.

In particular, the head portion 16 is formed by bending the metal rod around a forming piece (not shown), the forming piece being a pin having a size corresponding to the size of a clutch portion to pass through the head portion 16. By virtue of this forming process, any variation in the dimensions (particularly the diameter) of the metal rod will not alter the size of the aperture in the head portion 16. Accordingly, examples of the present invention are able to provide a superior tolerance for an effective, rigid coupling between the clutch and the anchor, thus avoiding a sloppy coupling between the anchor and the clutch. In other words, variation in the wire does not affect quality of engagement between the anchor and the clutch.

Also, by virtue of the anchor 10 being formed of from round cross-section metal rod, there is a single point of contact between the clutch portion and the anchor 10, avoiding the problems associated with skewed prior art anchors cut from metal plate which tend to transfer undesirable forces to the concrete component 12.

Figure 2:
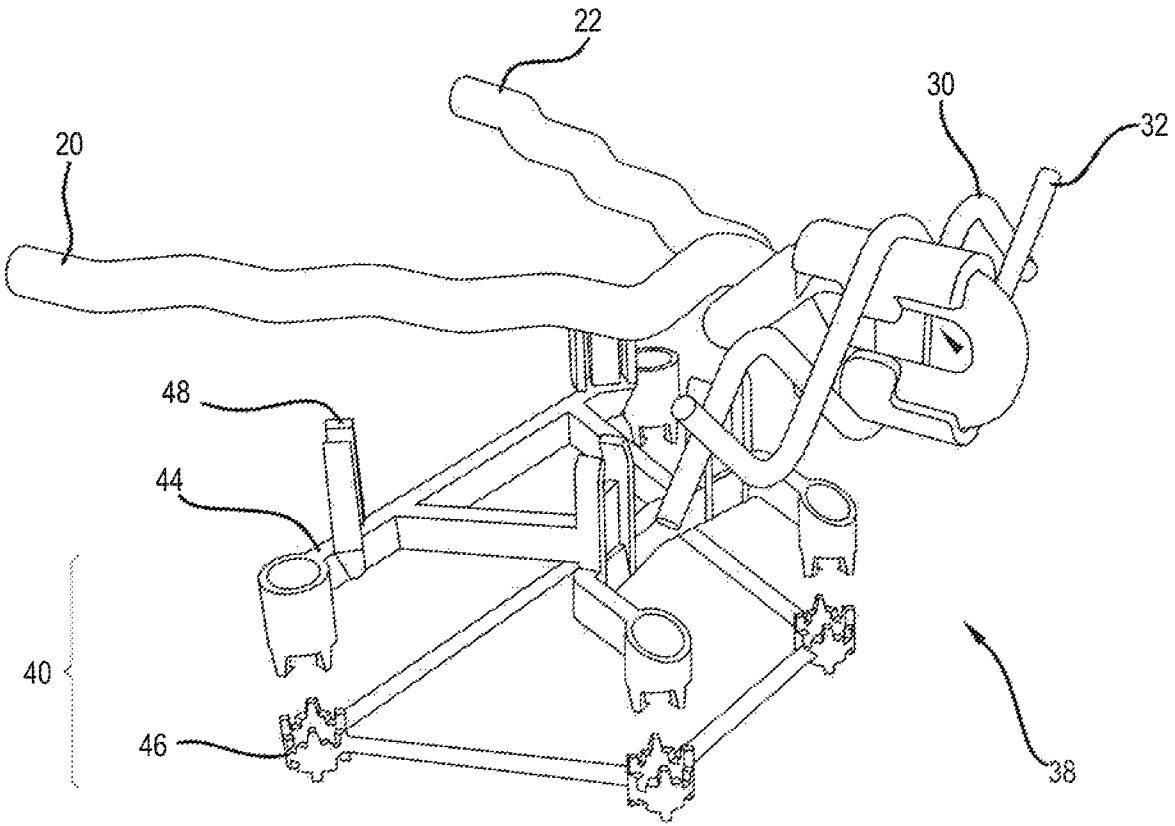
FIG. 2 is a perspective view of the anchor of FIG. 1, shown with an associated chair.
Figure 3:
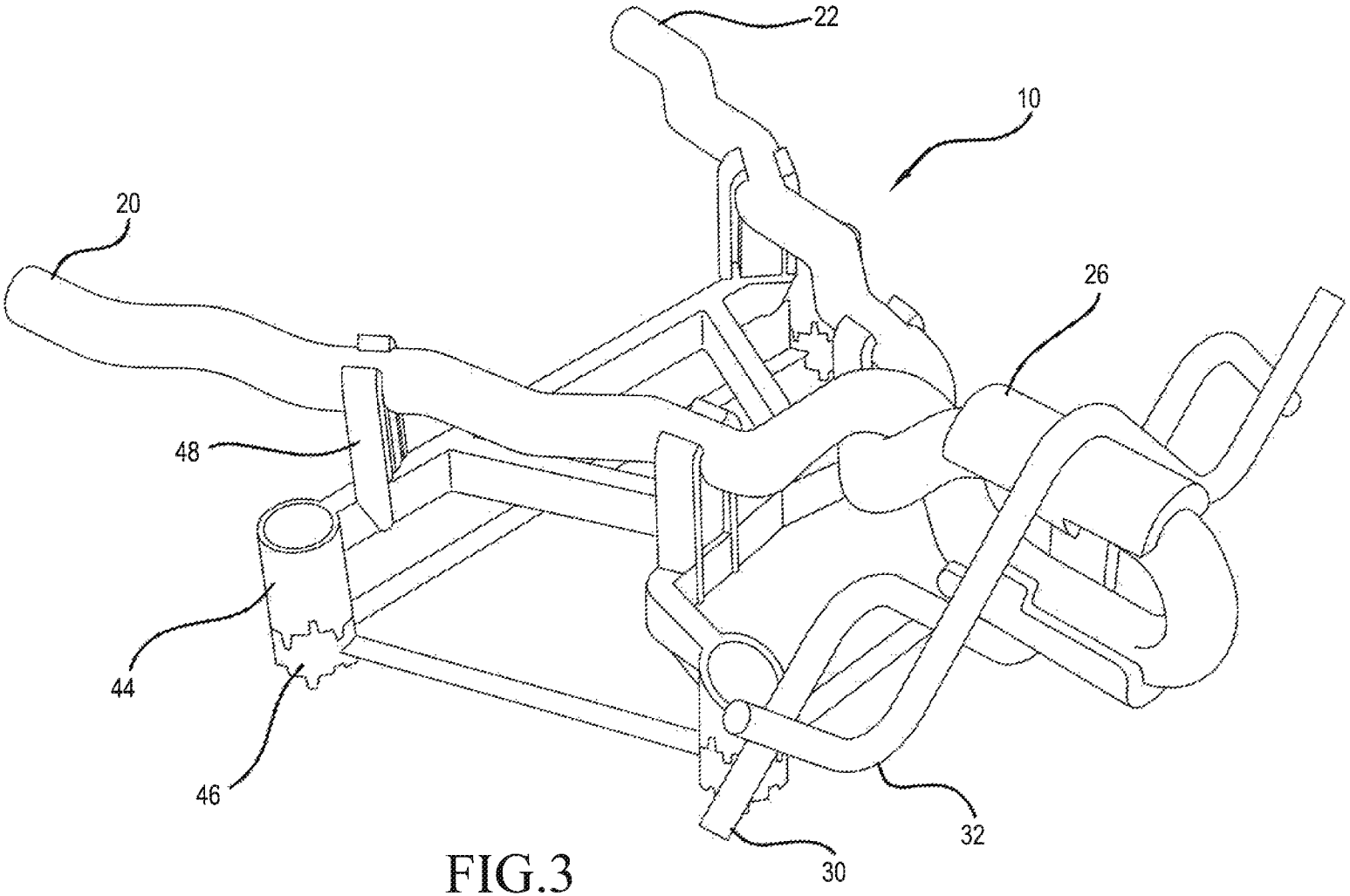
FIG. 3 is a perspective view of the anchor, shown with the chair fitted thereto.
Figure 4:
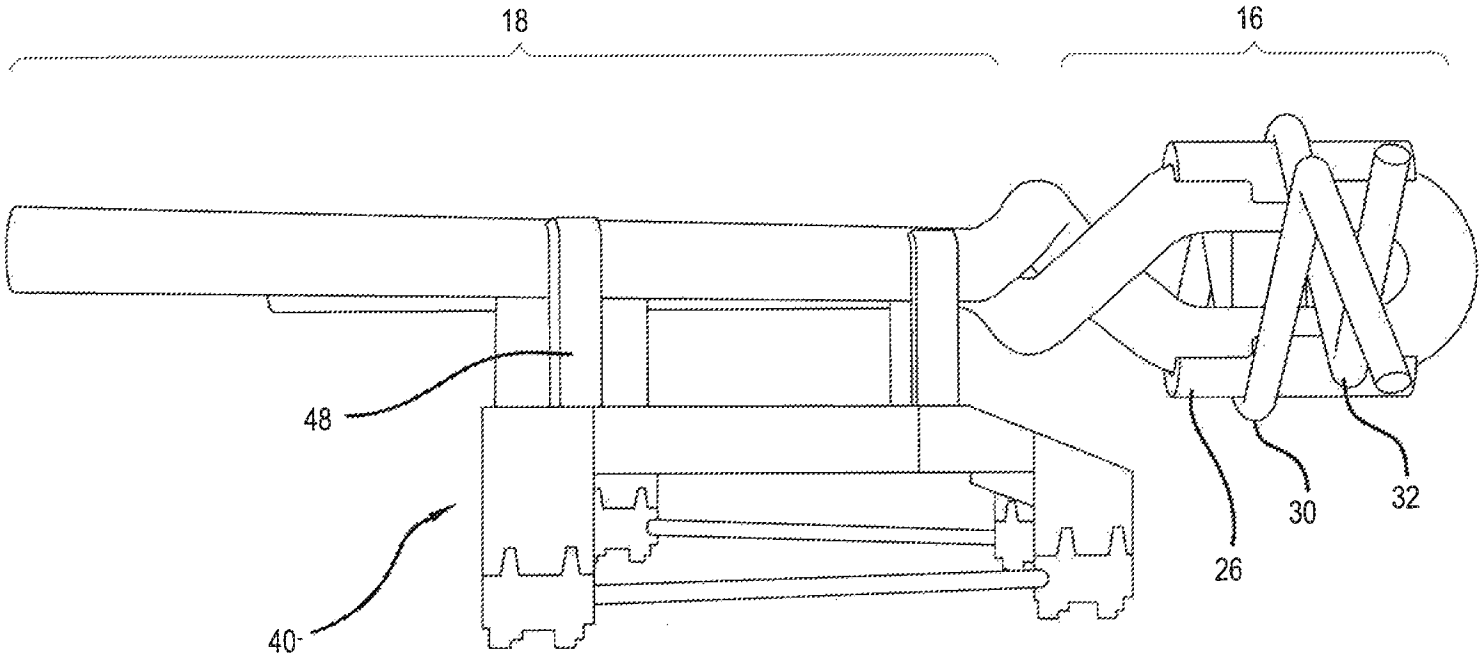
FIG. 4 is a side view of the anchor, with the chair fitted thereto.
Figure 5:
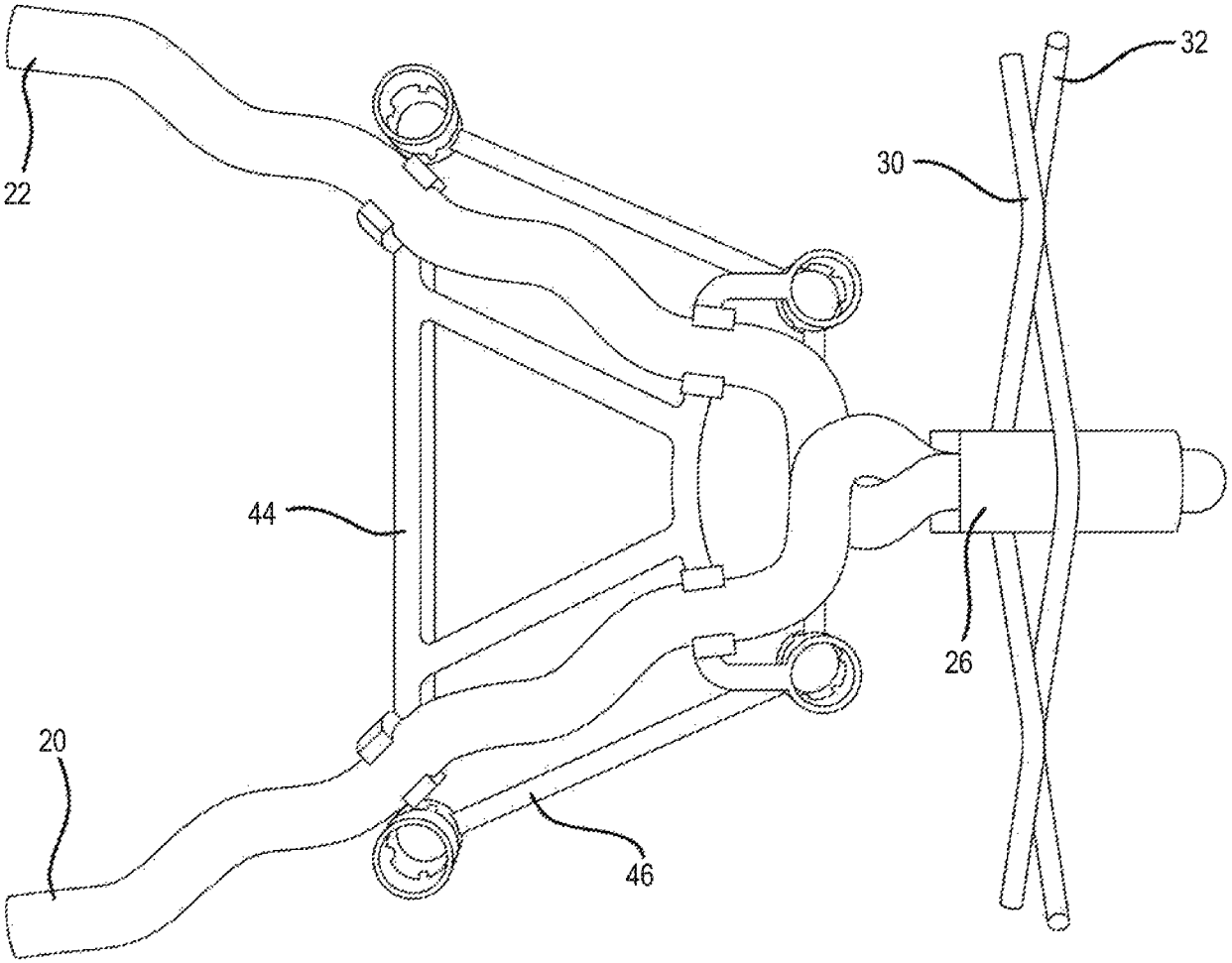
FIG. 5 is a top view of the anchor, with the chair fitted thereto.
Figure 6:
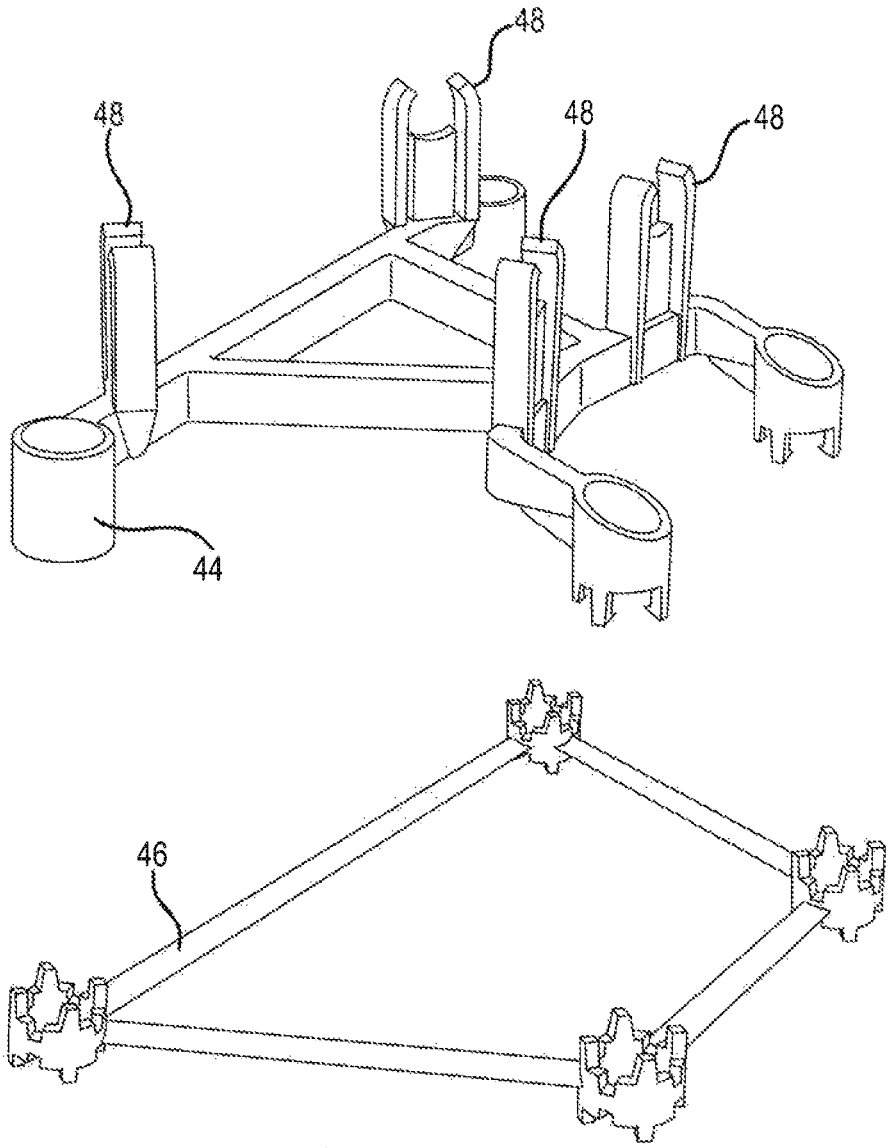
FIG. 6 is a perspective view of the chair shown in isolation, in a deconstructed condition.

With reference to FIG. 2, the anchor 10 forms part of an anchor assembly 38 which includes a chair 40. The chair 40 comprises an upper part 44 and a lower part 46 which are fitted together, with the upper part 44 having clips 48 for holding the anchor 10 in place relative to the chair 40, as shown in FIGS. 3 to 5. FIG. 6 shows an exploded view of the upper part 44 and the lower part 46. As the body portion 18 is in a plane perpendicular to the plane of the head portion 16, when in situ the opposed legs 20, 22 do not extend below the head portion 16, thus allowing the anchor 10 to be mounted in a relatively low position within the concrete component 12, while ensuring the opposed legs 20, 22 are embedded inside the concrete component 12. More particularly, the chair 40 is arranged for supporting the anchor 10 within the concrete component 12, with the plane of the body portion 18 coplanar or oriented substantially parallel to a central plane of the concrete component 12.

By virtue of the plane of the body portion 18 being coplanar with or substantially parallel to a central plane of the concrete component 12, it is possible for the body portion 18 to be located at or within a neutral axis of the concrete component 12 so as to avoid having the anchor embedded in regions of the concrete component 12 which are under high compression and/or tension during lifting. This may assist in avoiding failure of the concrete component 12 during lifting, and may enable lifting of concrete panels at a stage more premature (relative to the time of casting) than is required for lifting using existing concrete anchors.

Furthermore, the feature of the plane of the body portion 18 being coplanar with or substantially parallel to the central plane of the concrete component 12 enables the anchor to be used with concrete panels much thinner than is required for lifting using existing concrete anchors which extend transversely across a substantial portion of the thickness of the panel.

FIG. 7 shows an edge of a concrete component 12 in which the anchor 10 is partially embedded. A void 56 is formed around the head portion 16, and facilitates engagement of a clutch with the anchor 10 for lifting of the concrete component 12. Although in this drawing the anchor 10 is shown as being mounted in a central part of the concrete component 12, it will be appreciated by those skilled in the art that the anchor 10 may be mounted within the concrete component 12 in a lower location such that the plane of the body portion 18 is below the central plane of the concrete component 12.

Figure 8:
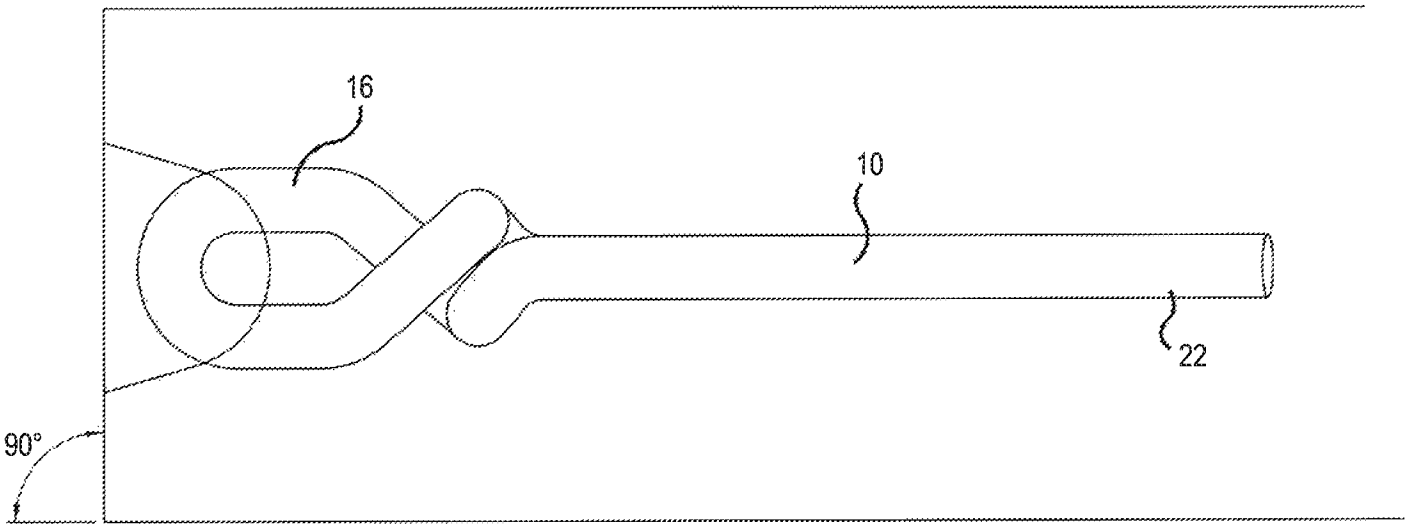
FIG. 8 is a diagrammatic side view of the anchor mounted within a concrete component, a head portion of the anchor being in line with a plane of the legs.
Figure 9:
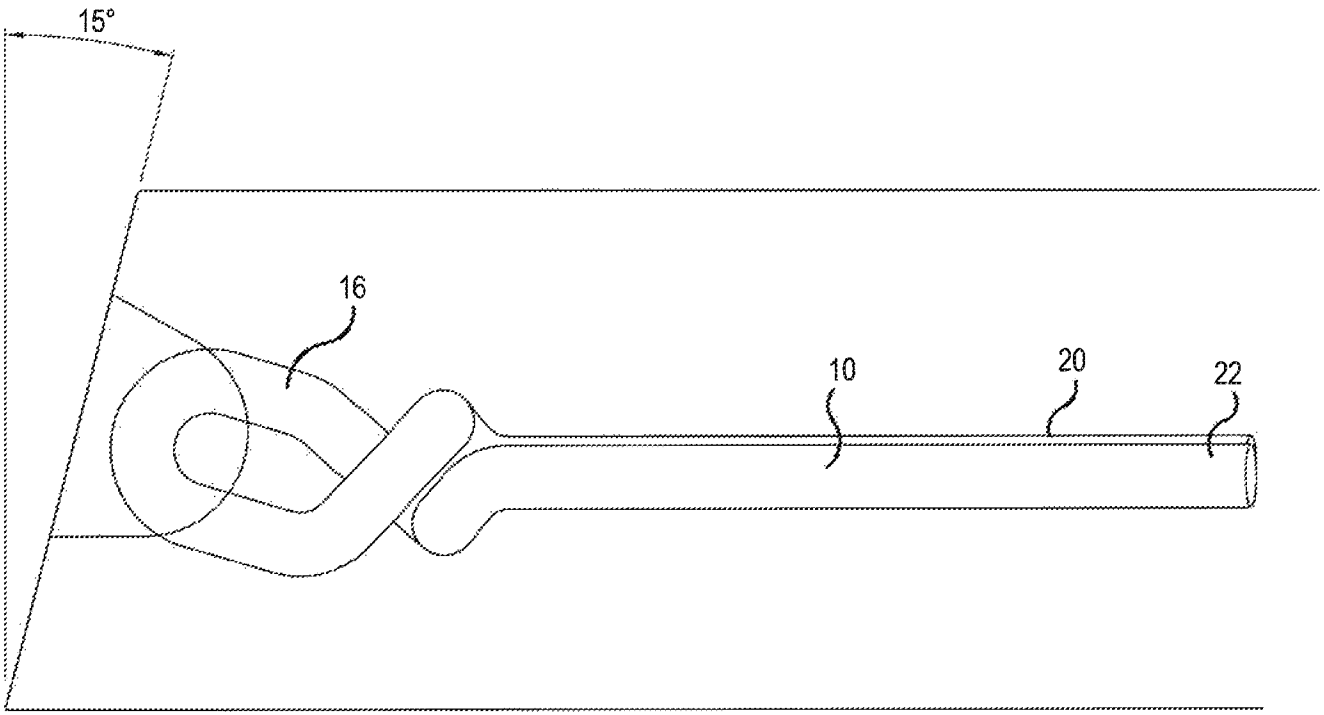
FIG. 9 is a diagrammatic side view of an anchor mounted within a concrete component, wherein a head portion of the anchor is bent upwards at an angle of 15 degrees.
Figure 10:
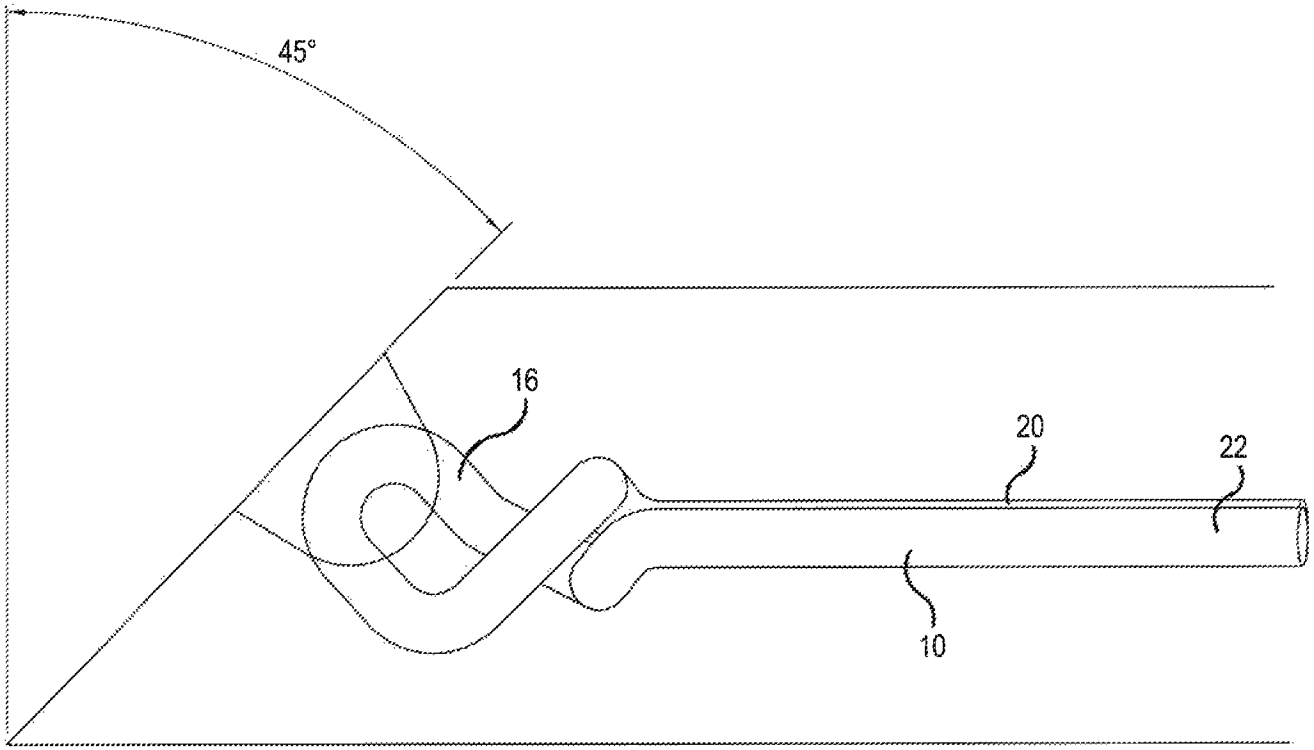
FIG. 10 is a diagrammatic side view of an anchor mounted within a concrete component, a head portion of the anchor being bent at an angle of 45 degrees to the plane of the legs.

With reference to FIGS. 8 to 10, the anchor 10 may be used for lifting concrete panels with varying edge profile angles by, prior to embedment of the body portion of the anchor within the concrete panel, bending the head portion 16 out of the plane of the legs 20, 22 by a corresponding angle. This bending may be effected on site to suit the particular application. In FIG. 8, the edge of the concrete panel is perpendicular to the main plane of the concrete panel, thus the head portion 16 is left in line with the plane of the legs 20, 22. In FIG. 9, the edge profile of the concrete panel is angled at 15 degrees, and the head portion 16 of the anchor is correspondingly bent upwards to an angle of 15 degrees relative to the plane of the legs 20, 22. Similarly, in FIG. 10, the edge profile of the concrete panel is angled at 45 degrees, and the head portion 16 of the anchor is bent upwards to a corresponding angle of 45 degrees relative to the plane of the legs 20, 22. It will be understood that the angle may vary between 0 and 90 degrees, however the most common angles of edge profile are 9 degrees, 15 degrees, 22.5 degrees, 30 degrees and 45 degrees.

While various embodiments of the present invention have been described above, it should be understood that they have been presented by way of example only, and not by way of limitation. It will be apparent to a person skilled in the relevant art that various changes in form and detail can be made therein without departing from the scope of the invention. Thus, the present invention should not be limited by any of the above described exemplary embodiments.

In particular, although the example anchor depicted in the drawings has an angle between the plane of the legs and the plane of the head portion of approximately 90 degrees, it will be understood that in alternative examples the angle between the plane of the legs and the plane of the head portion may take other values, for example 60, 45, 30 or 15 degrees. This angle may be dictated by the shape and/or orientation of the concrete component.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. An edge lifting anchor system for use in lifting a concrete component, said edge lifting anchor system, comprising:

(i) an anchor comprising a single length of wire bent to form a looped head portion dimensioned so as to allow a clutch portion to pass therethrough and engageable by a clutch of a lifting system, and a body portion for embedment within the concrete component, wherein the anchor is formed such that opposed legs of the body portion extend outwardly from a central axis and in a plane inclined to a plane of the looped head portion, each of the opposed legs having a series of ripples in a plane substantially at about 90 degrees to the plane of the looped head portion; wherein the looped head portion is twisted relative to the body portion about said central axis of the anchor relative to the plane of the looped head portion to form a loop of the looped head portion;

(ii) a collar adapted to fit around and engage the looped head portion, wherein the collar forms two abutment shoulders for cooperation with a body of the clutch to limit clutch rotation, the two abutment shoulders defining therebetween (a) a length the looped head portion wire about which the body of the clutch is capable of rotating and (b) two lengths of wire about which the body of the clutch is incapable of rotating; and (iii) a shear bar extending transversely to the looped head portion, wherein the shear bar is welded to the collar.

2. The edge lifting anchor system as claimed in claim 1, wherein an angle between the plane of the legs and the plane of the looped head portion is approximately 90 degrees.

3. The edge lifting anchor system as claimed in claim 1, wherein an angle between the plane of the legs and the plane of the portion is oblique.

4. The edge lifting anchor system as claimed in claim 1, wherein the plane of the looped head portion is inclined at an angle of 90 degrees about the central axis of the anchor relative to the plane of the body portion.

5. The edge lifting anchor system as claimed in claim 1, wherein the shear bar is formed in a generally sinusoidal shape, with oscillations in a direction generally transverse to the plane of the body portion.

6. The edge lifting anchor system as claimed in claim 1, including a second shear bar, wherein a major axis of the second shear bar is generally parallel to a major axis of the first shear bar and said second shear bar is substantially a mirror image of the first shear bar when viewed from an end of the anchor.

7. The edge lifting anchor system as claimed in claim 1, wherein the single length of wire is in the form of a length of metal bar, and the anchor is formed by bending the length of metal bar, wherein the looped head portion is formed by bending the metal bar around a forming piece, the forming piece having a size corresponding to a size of a clutch portion to pass through the looped head portion.

8. The edge lifting anchor system as claimed in claim 1, wherein the looped head portion is bent out of the plane of the legs by an angle corresponding to an offset angle of an edge profile of the concrete component.

9. The edge lifting anchor system as claimed in claim 8, wherein the angle is between 0 and 90 degrees.

10. The edge lifting anchor system as claimed in claim 9, wherein the angle is one of 9, 15, 22.5, 30, and 45 degrees.

11. An edge lifting anchor assembly including the anchor system as claimed in claim 1, and a chair for supporting the anchor during setting of the concrete component, with the plane of the body portion of the anchor being coplanar or oriented substantially parallel to a central plane of the concrete component.

* * * * *